US007059086B2

(12) United States Patent
Edvardsen

(10) Patent No.: US 7,059,086 B2
(45) Date of Patent: Jun. 13, 2006

(54) ADJUSTABLE ROOF FLASHING AND FLASHING KIT

(75) Inventor: Allan Edvardsen, Skanderborg (DK)

(73) Assignee: VKR Holding A/S, Soeborg (DK)

( * ) Notice: Subject to any disclaimer, the term of this patent is extended or adjusted under 35 U.S.C. 154(b) by 74 days.

(21) Appl. No.: 10/432,527

(22) PCT Filed: Nov. 26, 2001

(86) PCT No.: PCT/DK01/00783

§ 371 (c)(1),
(2), (4) Date: Nov. 14, 2003

(87) PCT Pub. No.: WO02/42578

PCT Pub. Date: May 30, 2002

(65) Prior Publication Data

US 2004/0103592 A1 Jun. 3, 2004

(30) Foreign Application Priority Data

Nov. 25, 2000 (DK) ..... 2000 01779

(51) Int. Cl.
*E04D 13/14* (2006.01)

(52) U.S. Cl. ..... 52/58; 52/60; 52/97; 52/200

(58) Field of Classification Search ..... 52/58–60, 52/97, 41–42, 200, 219, 287.1
See application file for complete search history.

(56) References Cited

U.S. PATENT DOCUMENTS

| | | | | |
|---|---|---|---|---|
| 1,370,199 A | | 3/1921 | Downs | |
| 2,641,203 A | * | 6/1953 | Coleman | 52/60 |
| 3,838,544 A | | 10/1974 | Hindall | |
| 3,878,655 A | * | 4/1975 | Toth et al. | 52/27 |
| 4,190,989 A | * | 3/1980 | Sakharoff | 52/60 |
| 4,917,345 A | | 4/1990 | Czech | |
| 4,951,431 A | | 8/1990 | Sweers | |
| 5,056,277 A | | 10/1991 | Wilson | |
| 5,109,641 A | * | 5/1992 | Halan | 52/62 |
| 5,381,632 A | * | 1/1995 | Damron | 52/58 |

(Continued)

FOREIGN PATENT DOCUMENTS

| | | |
|---|---|---|
| DK | 82857 C | 5/1975 |

(Continued)

*Primary Examiner*—Winnie Yip
(74) *Attorney, Agent, or Firm*—Merek, Blackmon & Voorhees, LLC

(57) ABSTRACT

The present invention relates to a flashing member for a roof-penetrating structure, comprising a first flashing portion (2) adapted to provide a seal against a roof and a second flashing portion (3) adapted to provide a seal between the first flashing portion and the roof penetrating structure. The first and second portions (2, 3) are interconnected in the mounted state, so that the flashing member provides a seal between the roof and the roof penetrating structure. In the state of delivery, the first and second portions (2, 3) of the flashing member are interconnected with each other in sliding engagement allowing the relative position between the first and second flashing portions to be adjusted during the mounting process. Adjusting means may comprise a first folded over part (11) creating a first narrow fold (13) on the first sheet portion (4) and a second folded-over part (14) creating a second narrow fold (16) on the second sheet portion (6), the two folds (13, 16) meshing with each other. The flashing member may comprise a corner element (10) arranged substantially perpendicularly to the first flashing portion (2) at an end thereof. The invention also relates to a flashing kit.

10 Claims, 2 Drawing Sheets

U.S. PATENT DOCUMENTS

| | | | | | |
|---|---|---|---|---|---|
| 5,409,266 | A | | 4/1995 | Baker | |
| 5,522,189 | A | * | 6/1996 | Mortensen et al. | 52/200 |
| 5,605,019 | A | * | 2/1997 | Maziekien et al. | 52/58 |
| 5,687,514 | A | | 11/1997 | Gillispie | |
| 6,108,981 | A | * | 8/2000 | Sama et al. | 52/60 |
| 6,212,834 | B1 | * | 4/2001 | Lindgren | 52/200 |
| 6,374,549 | B1 | * | 4/2002 | Mayle | 52/58 |

FOREIGN PATENT DOCUMENTS

| | | | |
|---|---|---|---|
| EP | 0410692 | * | 1/1991 |
| EP | 616096 | * | 10/1994 |
| JP | 10-299201 | * | 11/1998 |
| SE | 209300 C | | 11/1966 |
| WO | WO 95/28535 A1 | | 10/1995 |

* cited by examiner

ADJUSTABLE ROOF FLASHING AND FLASHING KIT

The present invention relates to a flashing member for a roof-penetrating structure, comprising a first flashing portion adapted to provide a seal against a roof; a second flashing portion adapted to provide a seal between the first flashing portion and the roof penetrating structure, the first and second portions being interconnected in a mounted state, the flashing member thus providing a seal between the roof and the roof penetrating structure, the first and second portions of the flashing member being interconnected in sliding engagement in a state of delivery allowing the relative position between first and second flashing portions to be adjusted during the mounting process. The invention further relates to a flashing kit comprising at least one such flashing member.

When flashing roof penetrating building structures, for example chimneys or frame structures for roof windows, in order to protect them from the weather and to provide a seal between the structure itself and the roof, it is common to use flashing covers of sheet metal, for instance aluminium, copper, steel or zinc. Conventionally, such flashing covers have been manufactured by ordinary tin man work from a plane sheet material which is profiled and formed to make a fit at the desire location.

The comparatively costly adjustment and assembly work on location, which is required when using this conventional craftsmanship, may be avoided by use of pre-manufactured flashing members. When these flashing members are used with, for example, a standard window type mounted in a given roof surface, it is possible to use the same standard flashing members regardless of, for example, the slope of an inclined roof surface.

Typically, a flashing assembly adapted to be used between, for example, a roof window and a sloping roof surface comprises upper and lower flashing members adapted to be mounted in a horizontal position between the upper and lower frame positions of the window and the roof surface, respectively, as well as first and second side flashing members adapted to be mounted in a sloping position between the two side frame portions of the window and the roof surface, respectively. Such a flashing assembly further comprises corner elements adapted to provide a seal between the side flashing members and the upper and lower flashing members, such corner elements often being integrated in either the upper and lower flashing members or the side flashing members.

However, some types of flashing members are not standard as they are dependent upon, for example, the actual position of the window frame relative to the roof surface. An example of this would be the desired height of the mounted window frame relative to the roof surface, the choice of which depends upon a number of factors, e.g. the roof material, the roof construction, the roof slope, the construction of the actual window frame as well as aesthetic considerations.

One type of flashing members, which has to be adapted with respect to the above mentioned variations are the flashing members used between the roof surface and the upper and lower frame portions, respectively, of a window frame. Depending on the circumstances and the specific construction of the flashing or the window, such flashing members may need to be adapted to both the slope of the roof and the height of the window frame relative to the roof surface.

In the past there have been attempts to provide flashing assemblies, which are adjustable so as to be adaptable under such different circumstances.

French patent application FR-A-2 606 808 discloses a flashing assembly to be mounted between the lower frame of, for example, a roof window and a roof surface and which assembly comprises three separate members allowing the flashing to be adapted to both the slope of the roof and the height of the window frame relative to the roof surface. More specifically, this known flashing assembly comprises three different members: a roof engaging skirt member, a first frame member which can be pivotably connected to an upper part of the skirt, and a second frame member adapted to be mounted on top of the frame partially covering the first frame member.

German patent application DE-A-21 42 733 is concerned with a similar flashing assembly comprising a skirt member and a second member adapted to be mounted on top of the frame and partially covering the upper part of the skirt member, thus providing a seal between the skirt member and the window frame. This flashing can be adjusted in a direction perpendicular to the plane of the roof to allow the adaptation to different types of roof coverings. However, the skirt member is formed of two different portions one of which depending on the shape of the roof covering and the other being formed to engage with the second flashing member. This means that a different flashing is needed for each type of roof covering occurring in practice, leading to relatively high production and storage costs and the risk of using of a wrong size flashing, which might lead to insufficient water tightness or a less desirable appearance.

A further flashing assembly is known from the German publication DE-A1-25 035 519.

The German patent applications, as well as the French mentioned above, disclose flashing assemblies consisting of a number of different parts that are to be assembled on site. A number of errors might originate in this assembling procedure and there is a risk that one or more parts may be forgotten or become missing. In addition the necessary in situ assembling of the flashing members involves the use of tools that could be dropped from the roof causing danger to persons on the ground. Also, if the tools were forgotten the fitter might be tempted to try to cope without them, which would inevitably lead to an inferior flashing.

SE-C-209 300 discloses a flashing assembly, in which small variations in the height direction may be compensated for by connecting a rail member with a flange. Due to the structure of the assembly, it is not possible to supply such an assembly with the parts in question in a pre-assembled state.

SE-B-416 072 discloses a flashing member of the kind mentioned in the introduction, in which a first portion, which is substantially flat and is intended to be positioned in the plane of the roofing, is provided with a telescopic connection between two plate members in order to secure that the first portion has a suitable width in relation to the tiles. In case the flashing is supplied with the plate members in an assembled state, the telescopic connection, however, entails a potential risk of unintentional disconnection of the plate members from each other.

It is thus a general object of the present invention to provide a flashing member, which enables roof flashings to be provided in an economical and efficient way, and in which the installation conditions are improved. A more specific object of the present invention is to provide a flashing member of the type adapted to provide a seal between a roof surface and an upper or lower portion of a roof-penetrating structure, especially an upper or lower frame portion of a roof window, the use of the flashing member being independent of the height of the part of the structure extending above the plan of the roof and the mounting of which involving no significant assembling operations to be carried out on the site of installation.

In the present context the terms "upper" and "lower" merely refer to the frame portion which are intended to be oriented up- and downwards when mounted in an inclined roof surface. However, in the broadest meaning, these terms denote two opposed portions of a given structure, for example a roof-penetrating structure mounted in a substantially horizontal manner.

According to the present invention, a flashing member of the kind mentioned in the introduction is provided which is furthermore characterized in that the first flashing portion comprises a first sheet portion and a skirt portion connected to a lower part thereof, the skirt portion being arranged at an angle relative to the plane of the first sheet portion, and the second flashing portion comprising a second sheet portion, the first and second sheet portions being interconnected in sliding engagement, that the first sheet portion further comprises an upper part, and the second sheet portion comprises upper and lower parts, the upper part of the first sheet portion being interconnected in sliding engagement with the lower part of the second sheet portion, and that at least one corner element is arranged substantially perpendicularly to the first flashing portion at a respective end thereof.

In addition to eliminating the drawbacks of prior art mentioned above, flashing assemblies consisting of adjustable flashing members according to the invention provide a number of advantages: Having fewer parts provide advantages when packing complete flashing kits (i.e. kits containing all the flashing members for, for example, a roof window) and fewer parts provide logistic advantages as well as the costs for storage are reduced. In most cases the flashing assembly according to the invention will in reality consist of the same number of elements as the prior art flashing assemblies, but since at least some of them are interconnected at delivery, the number of parts delivered and thus to be handled at the installation site will be smaller.

The interconnection in sliding engagement between the first and second sheet portions provides a particularly efficient assembling operation. The presence of corner elements allows a better water-proofing and may also facilitate the mounting of the flashing as the individual parts of the flashing member are not easily dismantled unintentionally during installation, the corner elements thus functioning as built-in locking means. This applies also in connection with repair and maintenance of the flashing member.

A further advantage is that complete, pre-assembled and adjustable flashing members make mounting easier. For example, if the flashing member comprises a specified primary skirt portion and a secondary frame portion, the skirt portion is first mounted correctly and the frame portion is thereafter simply pushed into contact with the window frame and then fastened. For this purpose, in a preferred embodiment where the skirt of the flashing member defines a general plane, the position of the second flashing portion is adjustable in a direction generally away from or towards the plane of the skirt. Indeed, depending on the specific construction a reverse mounting order may be specified. In addition to ease of mounting, it is ensured that the pre-assembled components are correctly mounted relative to each other, for example that an upper frame member overlaps a lower shirt portion in order to provide a proper seal, this being of special relevance when the flashings are sold as do-it-yourself products.

The skirt may be a simple sheet portion that can be mounted on top of or below a substantially planar roof surface. However, for use on roof surfaces in the form of undulated tiles with very deep troughs, skirts are used which can be manually deformed or stretched during mounting to enable a good fit between the flashing and roofing. Traditionally such skirts have been made of lead, however, in recent years lead-free skirts have been developed which are typically of a sandwich construction and which may be of wave-corrugated and pleated designs.

The flashing portions of the present invention may be interconnected in any suitable way providing the desired adjustability. For this purpose it is preferred that the first and second flashing portions are interconnected by connecting means having a generally transverse orientation allowing the flashing portions to be adjusted relative to each other in a direction generally perpendicular to the plane of the roof. In another preferred embodiment the skirt has a lower free edge, the connecting means allowing the flashing portions to be adjusted relative to each other in a direction generally perpendicular thereto. In still more preferred embodiments the first sheet portion comprises a folded-over upper part with a first flange having a first free edge, thereby creating a first narrow fold between the first sheet portion and the first flange, and the second sheet portion comprises a folded-over lower part with a second flange having a second free edge, thereby creating a second narrow fold between the second sheet portion and the second flange, the first flange being arranged in the second fold and the second flange being arranged in the first fold by which a connection is formed between the two sheet portions. The extreme simplicity of the structure of this particular embodiment imparts the advantage to the flashing member that risk of the connecting means being broken or jammed before or during mounting. Another example of connecting means is a bolt head or like projection mounted on one portion of the flashing member and embedded in a guide on the other portion thereof.

In case the first flashing portion has first and second opposed ends said at least one corner element may be arranged generally perpendicularly thereto.

In another preferred embodiment means is provided for locking the two flashing portions adjustably together thus preventing dismantling of the flashing member. The use of such locking means facilitates the mounting of the flashing member, as the different portions thereof can not come apart or be mutually displaced.

In accordance with its intended use the flashing member of the present invention has in its preferred embodiments, a general transverse orientation with respect to the width of the individual components, i.e. the sheet portions and the skirt, normally being the largest dimension, where the term "width" refers to the width of the roof-penetrating structure, e.g. roof window, in its mounted position with the width dimension parallel to a roof ridge; consequently, the distance between the lower free edge of the skirt and the upper frame-engaging portion may be said to represent the height of the flashing member. However, for special purposes flashing members may be provided for which the height is greater than the width.

A flashing kit according to the invention comprises at least one flashing member as defined above, these flashing members being adapted for use as an upper and/or a lower flashing members for a roof window. In a preferred embodiment the flashing kit also comprises two flashing members being adapted for use as side flashing members for a roof window. In a still more preferred embodiment said at least one corner element is intended for providing a seal between a side flashing member and an upper/lower flashing member, the corner element(s) preferably being integrated with the upper/lower flashing member(s). A kit of this kind is easily mounted as most or all of the members thereof are adjustable independent of the others. This is e.g. an advantage when the upper part of a roof window projects a greater distance from the plan of the roof than the lower part. The portions of lower flashing member may then be pushed further together than the portions of the upper one, and provided that connecting means of the side flashing members are not to narrow, the difference between, the top and bottom can be compensated for therein.

The invention will now be described in detail in the following with reference to the schematic drawings, in which like numerals refer to like elements and in which FIG. 1 is a perspective view illustrating a first embodiment of the present invention;

Figure 1:
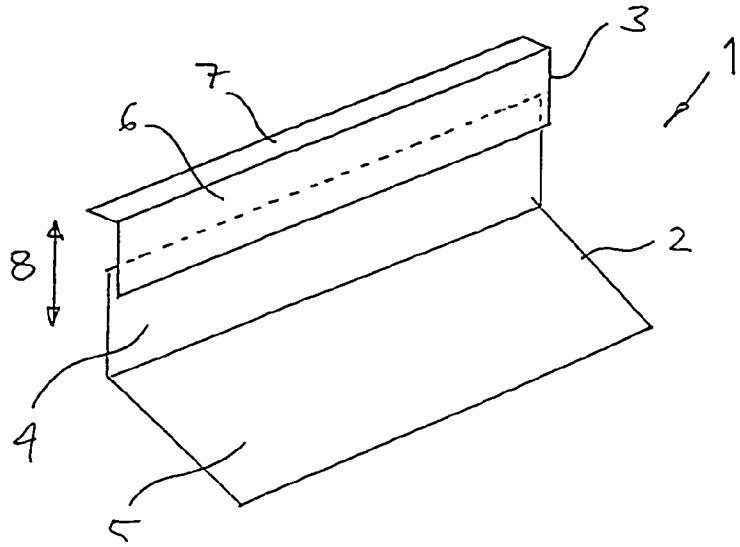
FIG. 1 shows a very schematic representation of a flashing member according to the present invention illustrating the principle of the invention.

The flashing member 1 comprises a first flashing portion 2 adapted to provide a seal against the roof, and a second flashing portion 3 adapted to provide a seal between the first flashing portion and the roof penetrating structure such that the composite flashing member provides a seal between the roof and the roof penetrating structure. The first flashing portion comprises a first sheet portion 4 and a skirt portion 5 connected to a lower part thereof, the skirt portion being arranged at an angle relative to the plane of the first sheet portion. The second flashing portion comprises a second sheet portion 6 as well as an optional upper flange 7 adapted to engage an upper or lower surface on a window frame portion. As illustrated by the arrow 8 the first and second sheet portions are arranged in sliding engagement and held together by cooperating, adjustable connecting means. These connecting means may e. g. be designed as shown in further detail in FIGS. 3 and 4 and described in connection therewith. The shown skirt is a plane sheet portion which is adapted to be mounted on top of a substantially planar roof surface or below a roof surface, however, for use on roof surfaces in the form of undulated tiles with deep troughs, the skirt can be made from materials which can be manually deformed or stretched during mounting to enable a good fit between the flashing and roofing, such materials including wave undulated or pleated laminates. In the figure the skirt is arranged in a downwardly sloping position relative to the first sheet portion, however, the skirt may be arranged in any desired angle. The skirt may also be arranged in such a way that the angle between the skirt and the first sheet portion can be adjusted, for example by a connection allowing pivoting there between.

Figure 2:
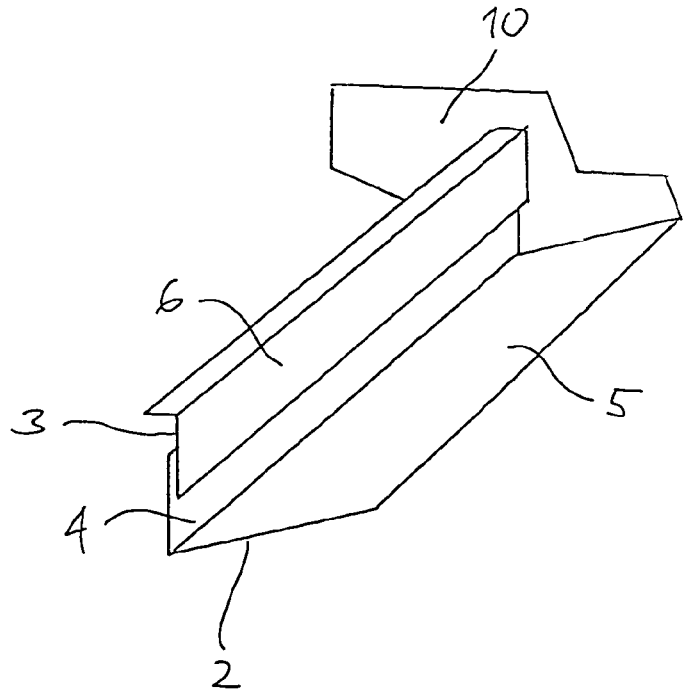
FIG. 2 is a perspective view illustrating a second embodiment of the present invention.

FIG. 2 shows a preferred embodiment of the present invention, comprising, as the FIG. 1 embodiment, a first flashing portion 2 with a first sheet portion 4 and a thereto connected skirt portion 5 and a second flashing portion 3 with a second sheet portion 6. In contrast to the FIG. 1 embodiment the skirt is arranged in an upwardly sloping position relative to the first sheet portion. The first and second sheet portions are arranged in sliding engagement and held together by cooperating, adjustable connecting means (not shown).

The flashing members of the present invention are particularly useful as upper and lower flashing members for a roof mounted window frame. A typical flashing for a roof window comprises upper and lower flashing members as well as two side flashing members. In order to provide a seal between the upper and lower flashing members, respectively, and the side flashing members corner elements are provided which may be formed integrally with either the upper/lower or the side flashing members. In the FIG. 2 embodiment the flashing member comprises a corner element 10 arranged substantially perpendicular to the general planes of the skirt 5 and the sheet portions 4, 6 at an end thereof and adapted to engage a side flashing member. Preferably the flashing member also comprises a corner element at the opposite end.

Figure 3:
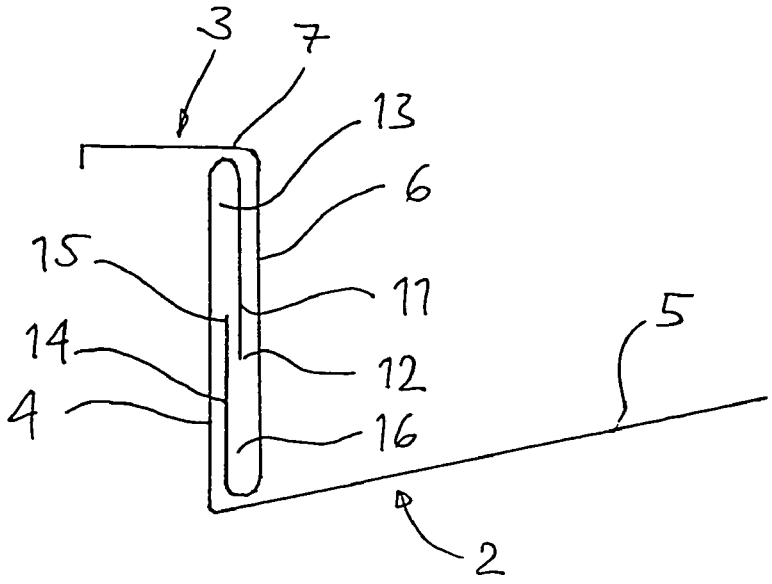
FIG. 3 is a perspective view illustrating a further embodiment of the present invention with an upper flashing portion in a lowermost position.
Figure 4:
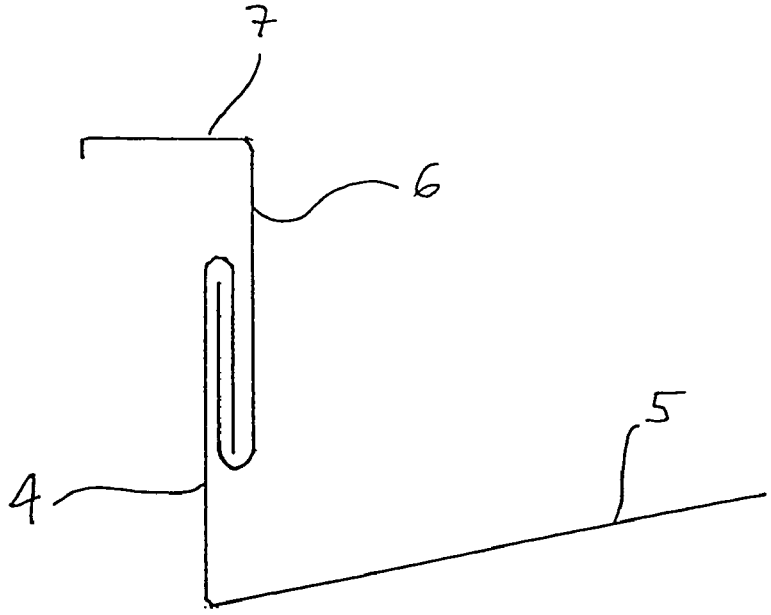
FIG. 4 is a perspective view illustrating the same embodiment as in FIG. 3 with the upper flashing portion in its uppermost position.

FIGS. 3 and 4 show a schematic cross-sectional view through a preferred embodiment for the adjustable flashing member of the present invention. The flashing member comprises a first flashing portion 2 with a first sheet portion 4 and a thereto connected skirt portion 5 and a second flashing portion 3 with a second sheet portion 6. The first sheet portion comprises a folded-over upper portion with a downwardly facing first flange 11 having a first free edge 12, thereby creating a first narrow fold 13 between the first sheet portion and the first flange. The second sheet portion 3 comprises a folded-over lower portion with an upwardly facing second flange 14 having a second free edge 15, thereby creating a second narrow fold 16 between the first sheet portion and the first flange. In the assembled state the first flange is arranged in the second fold and the second flange is arranged in the first fold by which a connection is formed between the two sheet portions. As appears from FIGS. 3 and 4 the flanges are arranged in such a way that the two flashing portions can be adjusted relative to each other, i.e. up- and downwards with regard to the orientation of the figures on the paper. FIG. 3 illustrates a flashing member in which the second flashing portion is positioned in a lowermost position relative to the first flashing portion, and FIG. 4 illustrates the same flashing member in which the second flashing portion is positioned in an upper-most position relative to the first flashing portion. As appears from FIGS. 3 and 4 the flanges 11, 14 and free edges 12, 15 are in all positions kept in an overlapping manner which ensures that the flashing portions do not easily come apart during normal mounting procedures. Indeed, it would be possible to dismantle the two portions by sliding them away from each other along the longitudinal axes of the flanges and folds. However, additional locking means may be provided thereby fully preventing dismantling.

It will be understood that the embodiments described herein are merely exemplary and that a person skilled in the art may make many variations and modifications without departing from the scope of the invention. For example, the adjustable connection between the two flashing portions 2, 3 could be provided by a variety of means, including a pin and slot arrangement.

The invention claimed is:

1. A flashing member for a roof window, comprising:

a first flashing portion adapted to provide a seal against a roof;

a second flashing portion adapted to provide a seal between the first flashing portion and the roof window, the first and second portions being interconnected in a mounted state, the flashing member thus providing a seal between the roof and the roof window, the first and second portions of the flashing member being interconnected in sliding engagement in a state of delivery allowing the relative position between the first and second flashing portions to be adjusted during the mounting process, wherein the first flashing portion comprises a first sheet portion and a skirt portion connected to a lower part thereof, the skirt portion being arranged at an angle relative to the plane of the first sheet portion, and the second flashing portion (3) comprising a second sheet portion, the first and second sheet portions being interconnected in sliding engagement, wherein the first sheet portion further comprises an upper part, and the second sheet portion comprises upper and lower parts, the upper part of the first sheet portion being interconnected in sliding engagement with the lower part of the second sheet portion, and wherein the flashing member further comprises at least one corner element is arranged substantially perpendicularly to the first flashing portion at a respective end thereof, said corner element being adapted to provide a seal between the flashing member and an adjacent flashing member.

2. A flashing member as defined in claim 1, wherein the first flashing portion has first and second opposed ends, and wherein said at least one corner element is arranged generally perpendicularly thereto.

3. A flashing member as defined in claim 1, wherein the skirt defines a general plane, the position of the second flashing portion being adjustable in a direction generally away from or towards the plane of the skirt.

4. A flashing member as defined in claim 1, wherein the first and second flashing portions are interconnected by connecting means having a generally transverse orientation allowing the flashing portions to be adjusted relative to each other in a direction generally perpendicular to the plane of the roof.

5. A flashing member as defined in claim 1, wherein the skirt has a lower free edge, and wherein connecting means interconnecting the first and second flashing portions and having a generally transverse orientation allows the flashing portions to be adjusted relative to each other in a direction generally perpendicular thereto.

6. A flashing member as defined in claim 1, wherein the first sheet portion comprises a folded-over upper part with a first flange having a first free edge, thereby creating a first narrow fold between the first sheet portion and the first flange, and wherein the second sheet portion comprises a folded-over lower part with a second flange having a second free edge, thereby creating a second narrow fold between the second sheet portion and the second flange, the first flange being arranged in the second fold and the second flange being arranged in the first fold by which a connection is formed between the two sheet portions.

7. A flashing member as defined in claim 1, wherein locking means is provided for locking the two flashing portions adjustably together thus preventing dismantling thereof.

8. A flashing kit comprising at least one flashing member as defined in claim 1, the flashing member(s) being adapted for use as an upper and/or a lower flashing member(s) for a roof window.

9. A flashing kit as defined in claim 8, further comprising two flashing members being adapted for use as side flashing members for a roof window.

10. A flashing kit as defined in claim 9, wherein said at least one corner element is intended for providing a seal between a side flashing member and an upper/lower flashing member, the corner element(s) preferably being integrated with the upper/lower flashing member(s).

* * * * *